United States Patent [19]

Yanagishima et al.

[11] Patent Number: 4,571,274

[45] Date of Patent: Feb. 18, 1986

[54] METHOD FOR CONTINUOUS ANNEALING OF A METAL STRIP

[75] Inventors: Fumiya Yanagishima; Toru Sasaki; Takaaki Hira; Hideo Abe, all of Chiba; Kouichi Tahara, Hyogo; Yuji Shimoyama, Chiba, all of Japan

[73] Assignee: Kawasaki Steel Corporation, Hyogo, Japan

[21] Appl. No.: 649,425

[22] Filed: Sep. 11, 1984

Related U.S. Application Data

[63] Continuation-in-part of Ser. No. 543,364, Oct. 19, 1983, abandoned.

[30] Foreign Application Priority Data

Oct. 28, 1982 [JP] Japan ..... 57-188257
Dec. 19, 1983 [JP] Japan ..... 58-239523

[51] Int. Cl.[4] ..... C21D 9/52

[52] U.S. Cl. ..... 148/156; 432/8; 226/189

[58] Field of Search ..... 148/155, 156; 266/103, 266/106; 226/189, 190, 191, 195, 196; 432/8, 59

[56] References Cited

U.S. PATENT DOCUMENTS

| | | | |
|---|---|---|---|
| 1,971,666 | 8/1934 | Webster | 432/8 |
| 2,573,019 | 10/1951 | Hess | 266/110 |
| 2,666,003 | 1/1954 | Dougherty et al. | 266/110 |
| 2,706,625 | 4/1955 | Lorig | 432/59 |
| 3,021,128 | 2/1962 | Jonason | 432/8 |
| 3,284,073 | 11/1966 | Engelhardt | 266/110 |
| 3,477,138 | 11/1969 | Snow | 432/8 |
| 4,358,093 | 11/1982 | Shimoyama et al. | 266/259 |
| 4,371,332 | 2/1983 | Matsuo et al. | 432/1 |
| 4,375,283 | 3/1983 | Shimoyama et al. | 266/44 |

FOREIGN PATENT DOCUMENTS

| | | | |
|---|---|---|---|
| 152932 | 11/1981 | Japan | 266/103 |

*Primary Examiner*—Melvyn J. Andrews
*Assistant Examiner*—Robert L. McDowell
*Attorney, Agent, or Firm*—Bierman, Peroff & Muserlian

[57] ABSTRACT

In the operation of a continuous-process annealing furnace for a steel strip of a continuous length which is guided through the high-temperature zones of the furnace by the upper and lower hearth rolls in an alternate up and down vertical movement, each of the hearth rolls having an end-tapered or crowned configuration to correct the meandering of the running strip, each of the hearth rolls is coupled with one or a plural number of straightly cylindrical auxiliary rolls in contact with the strip at a position close to the hearth roll. By virtue of the installation of the auxiliary rolls, the phenomenon of wrinkling or buckling in the steel strip can be effectively prevented without causing meandering and the effect is more remarkable when specific relationships are held among the values of the diameters of the hearth roll and auxiliary roll and the position of the auxiliary roll relative to the hearth roll.

4 Claims, 21 Drawing Figures

METHOD FOR CONTINUOUS ANNEALING OF A METAL STRIP

PRIOR APPLICATION

This application is a continuation-in-part of our copending U.S. patent application Ser. No. 543,364 filed Oct. 19, 1983, abandoned.

BACKGROUND OF THE INVENTION

The present invention relates to a method for continuously annealing a metal, e.g. steel, strip of continuous length in a vertical annealing furnace. More particularly, the invention relates to a method for continuously annealing a metal strip by passing through a vertical annealing furnace as being guided by a sequence of rolls where meandering and buckling deformation of the running metal strip can effectively be prevented.

Annealing of a metal strip of continuous length is performed usually by passing through an annealing furnace comprising a heating zone, a soaking zone and a cooling zone connected in series and the metal strip runs through these zones in this order. In a vertical annealing furnace, each zone is provided with two sets of hearth rolls in the upper and lower parts with their axes substantially in parallel with each other and the running metal strip is guided alternately by one of the upper rolls and one of the lower rolls hanging thereon to move vertically up and down between the rolls and to be finally introduced into the next zone.

One of the problems in the operation of an annealing furnace of this type is meandering of the running metal strip as it runs contacting with and winding around each hearth roll. The meandering here implied is a phenomenon that the center line of the running metal strip deviates to the right or left from the axial center of the hearth roll by the shift of the metal strip in the transverse direction.

In order to prevent the running metal strip from meandering as mentioned above, each zone of a conventional vertical annealing furnace is provided with one or two steering rolls to control the positioning of the metal strip. This means is, however, not quite effective so that it is generally understood that complete prevention of meandering of the metal strip is rather a difficult matter.

The hearth roll in the annealing furnace of the above described type usually has a configuration tapered at both end portions or a crowned configuration having varying diameters largest at the center and decreasing continuously toward the ends with a purpose to decrease meandering of the running metal strip in contact therewith. The principle in this case is the same as in the power transmission mechanism with belt and pulley in which a crowned or end-tapered pulley prevents the belt from coming off the pulley. In the belt and pulley of this type for power transmission, the belt coming into contact with the pulley is urged toward the center of the pulley where the diameter thereof is the largest because the belt is moved together with the pulley while it is kept in contact with the pulley by means of the friction therebetween. Similarly, the metal strip hanging on and guided by the hearth roll of the above mentioned configuration is urged toward the center portion of the roll where the diameter is the largest.

As a consequence of the use of a hearth roll which is not of a straightly cylindrical form, the distribution of the tensile stress in the longitudinal direction of the metal strip cannot be uniform in the transverse direction. In particular, the non-uniformity of the tension in the metal strip is increased when the taper angle of an end-tapered roll or the surface curvature of a crowned roll is large, when the thermal expansion of the hearth roll is larger at the center portion than at the side portions due to the heat radiation within the furnace and when the tension in the longitudinal direction of the metal strip is increased. When the tensile stress in the longitudinal direction has a non-uniform distribution in the transverse direction, a compressive stress is produced within the metal strip as a consequence. Accordingly, buckling of the metal strip sometimes takes place when this compressive stress exceeds a certain value.

When the hearth roll has an end-tapered configuration, for example, the buckling first takes place at positions contacting with the shoulder portions of the roll or the boundary portions between the straightly cylindrical portion at the conically tapered portions of the roll. Such a phenomenon of buckling should be avoided by all means not only due to the degraded product quality but also due to possible breaking of the metal strip depending on the extent of buckling. Once such a break has taken place in the metal strip, the whole process is unavoidably in great troubles including damage to the annealing furnace per se.

The phenomenon of buckling in the metal strip can of course be obviated when the hearth roll is of a straightly cylindrical form without end-tapering or crowning. Such a measure, however, cannot be undertaken in consideration of the meandering of the running metal strip. Thus, it has been eagerly desired to develop a method for simultaneously preventing meandering of and buckling in the running metal strip.

In recent years, on the other hand, a great variety of grades are desired in the supply of cold-rolled steel strips not only in the dimensions but also in the strengths as a material. It would be extremely difficult in the continuous annealing furnace of metal strips of the above described type, however, to simultaneously preventing meandering of and buckling in the running metal strip for all kinds of cold-rolled steel strips of different dimensions and under different conditions of thermal treatment by a mere optimization of the configuration of the hearth roll alone or rather to design a hearth roll to meet such a requirement.

SUMMARY OF THE INVENTION

It is therefore an object of the present invention to provide a novel and improved method for continuously annealing a metal strip of a continuous length in an annealing furnace of the above described type in which the undesirable phenomena of meandering of and buckling in the running metal strip can simultaneously and efficiently be prevented by use of a hearth roll having an end-tapered or crowned configuration irrespective of the grades of the metal, e.g. steel, strip in respect of the dimensions of the strip and kinds of the steel.

Thus, the method of the present invention for continuously annealing a steel strip of a continuous length comprises, in a process in which the steel strip is passed through a vertical annealing furnace comprising a heating zone, a soaking zone and a cooling zone connected in series and the steel strip runs through these zones in this order, each of which zones is provided with two sets of hearth rolls each having an end-tapered or crowned configuration in the upper and lower parts with their axes being substantially in parallel with each other, the running steel strip being guided alternately by one of the upper rolls and one of the lower rolls hanging thereon to move vertically up and down between the rolls, providing at least one straightly cylindrical roll having a diameter DA in the vicinity of the hearth roll of which the largest diameter is DH and at a position in which the straightly cylindrical roll can be contacted with the running steel strip, keeping the height difference LV between the axes of the hearth roll and the cylindrical roll not larger than 3.6 times of DH, and keeping the tension of the running steel strip not smaller than 1.5 times of a critical tension in excess of which buckling takes place in the steel strip in the absence of the straightly cylindrical roll.

It has been established experimentally that further improvements can be obtained when a certain inequality is satisfied between the ratio LH/DH, LH being the distance between the vertical projections of the axes of the hearth roll and the cylindrical roll, and the ratio DA/DH, the constant term and the coefficient in the inequality being dependent on the relative disposition of the hearth roll, cylindrical roll and running steel strip.

DETAILED DESCRIPTION OF THE PREFERRED EMBODIMENTS

In the following, the method of the present invention is described in detail with reference to the accompanying drawings making comparison with the conventional prior art method.

Figure 1:
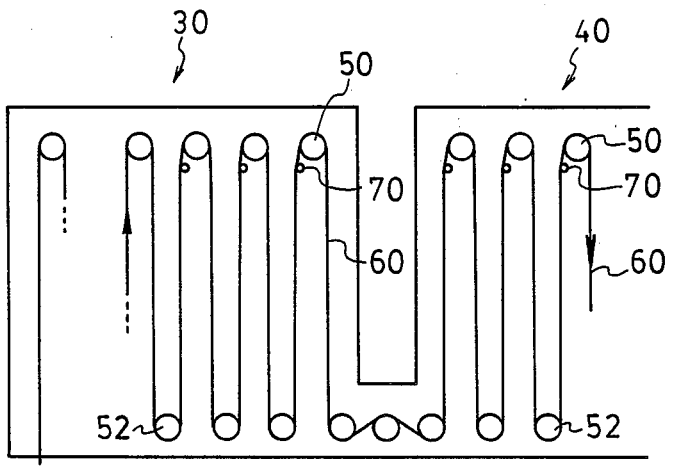
FIG. 1 is a sectional view of a part of an annealing furnace used in the inventive method as cut along the longitudinal direction.

In FIG. 1 showing a schematic sectional view of the heating zone 30 and the soaking zone 40 of a vertical-type annealing furnace, a steel strip 60 introduced into the heating zone 30 at the left end thereof runs through the zone in an up and down movement by alternately hanging on and being guided by the sets of the upper hearth rolls 50 and the lower hearth rolls 52 while under heating by a heating means (not shown in the figure). The thus heated steel strip 60 leaves the heating zone 30 to enter the soaking zone 40 where the strip 60 is kept at the soaking temperature while it is advancing in an up and down movement in just the same manner as in the heating zone 30. The steel strip 60 thus soaked for a sufficient length of time then leaves the soaking zone 40 to be introduced into the cooling zone (not shown in the figure) at the right of the soaking zone 40.

Auxiliary cylindrical rolls 70 are provided each below the last three upper hearth rolls 50 in the heating zone 30 and first three upper hearth rolls 50 in the soaking zone 40. The subject matter of the present invention is in connection with the running procedure of such an annealing furnace provided with the auxiliary cylindrical rolls at a specific disposition relative to the hearth rolls.

Figure 2:
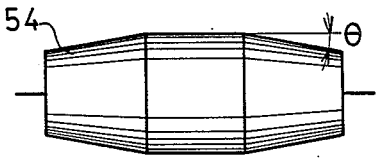
FIG. 2 is a front view of a hearth roll tapered at both ends used in the annealing furnace.
Figure 3:
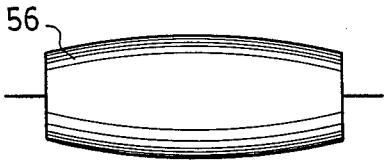
FIG. 3 is a front view of a crowned hearth roll used in the annealing furnace.
Figure 4:
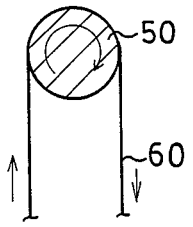
FIG. 4 is a cross sectional view of a hearth roll and a steel strip hanging thereon as viewed in the axial direction of the roll.
Figure 5:
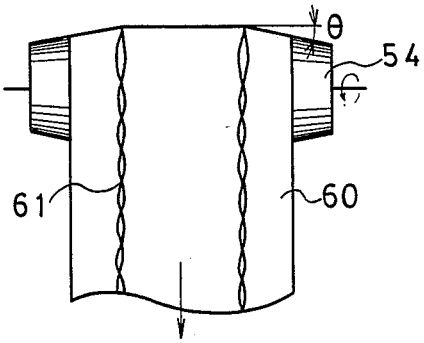
FIG. 5 is an elevational view of a hearth roll and a steel strip hanging on and leaving the hearth roll with buckling.

As is mentioned before, each of the hearth rolls 50 has a configuration tapered at both ends 54 shown in FIG. 2 or a crowned configuration 56 shown in FIG. 3 with an object to prevent the running steel strip 60 hanging thereon from meandering. In either case, a cross sectional view of a hearth roll 54 or 56 and a steel strip 60 hanging thereon as cut perpendicularly to the roll axis is as shown in FIG. 4. FIG. 5 schematically illustrates the surface condition of a steel strip 60 leaving an end-tapered hearth roll 54 after winding therearound. The wavy or chain-like lines 61 indicate buckling produced in the steel strip 60 at the positions in contact with the shoulder portions of the end-tapered hearth roll 54.

The inventors have undertaken extensive investigations in order to elucidate the mechanism for the occurrence of such a phenomenon of buckling in the running steel strip 60 by varying various parameters including the shape and dimensions of the hearth rolls, width and thickness of the steel strip and others arriving at a conclusion that the buckling takes place at a moment just before and just after contacting of the steel strip with the hearth roll 50.

Figure 6:
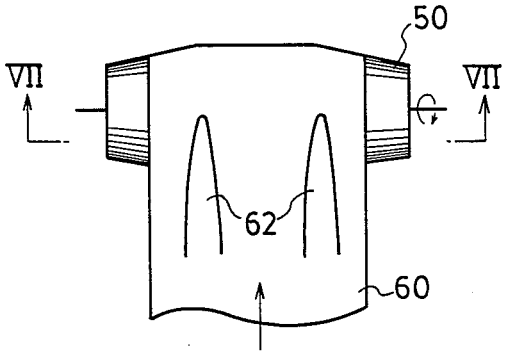
FIG. 6 is an elevational view of a hearth roll and a steel strip hanging on and advancing toward the roll which wrinkles.
Figure 7:
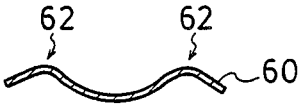
FIG. 7 is a cross sectional view of the steel strip in FIG. 6 as cut and viewed along the arrows VII—VII.

FIG. 6 illustrates an elevational view of an end-tapered hearth roll 50 and a steel strip 60 advancing toward the roll 50. As is shown by the curved lines 62, wrinkles are formed on the steel strip 60 as the strip approaches the roll 50 but still not in contact therewith. FIG. 7 illustrates a cross section of such a wrinkled steel strip 60 as cut and viewed along the arrows VII—VII in FIG. 6 with some magnification of the wrinkles 62.

As is understood from FIGS. 6 and 7, when running under a longitudinal tension a compressive membrane stress in the transverse direction is produced within the steel strip 60 at the portions of the strip to be brought into contact with the shoulders of the end-tapered hearth roll 50 to cause wrinkles 62 on the steel strip just before reaching the hearth roll 50 so that the steel strip 60 winds around the hearth roll 50 in the wrinkled condition as such. Unless the wrinkles 62 on the steel strip 60 are dissolved while the strip 60 is in contact with the roll 50, the running steel strip 60 necessarily undergoes bending and unbending in the succeeding hearth rolls 50, 52 one by one so that buckling would take place with periodical creases as illustrated in FIG. 5. The above presumption is in good consistency with the experience in an actual operation of an annealing furnace. Notwithstanding the eventuality of buckling predicted by the above given analysis, no measure is taken in the conventional annealing furnaces against the wrinkles formed under tension so that the phenomenon of buckling frequently takes place under wide operational conditions.

The scope of the inventive method consists in the prevention of a steel strip from the above described undesirable deformation by an adjunctive installation of an auxiliary cylindrical roll at each hearth roll to correct the incipient deformation of the strip so that the eventuality of buckling can be minimized. In particular, the best results are obtained when the auxiliary cylindrical roll is installed in a specific disposition relative to the hearth roll.

In the inventive method, each of the hearth rolls in a heat treatment zone of an annealing furnace is coupled with at least one auxiliary cylindrical roll with its axis substantially in parallel with that of the hearth roll at a position where the auxiliary roll can be contacted with the running steel strip just before reaching the hearth roll. FIGS. 9 to 13 each illustrate a cross section of an arrangement of the auxiliary cylindrical rolls relative to the hearth roll 50 both in contact with the running steel strip 60.

Figure 14:
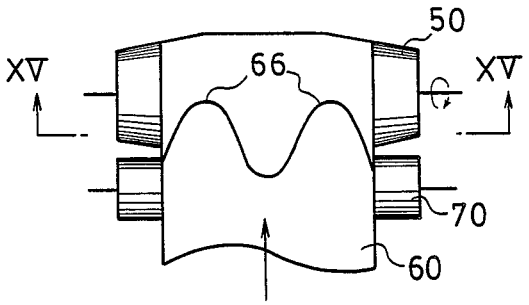
FIG. 14 is an elevational front view of the assembly shown in FIG. 9 as viewed on the advancing side of the steel strip.
Figure 15:
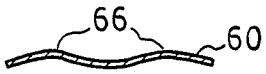
FIG. 15 is a cross sectional view of the steel strip in FIG. 14 as cut and viewed along the arrows XV—XV.

In the arrangement shown in FIG. 9, an auxiliary cylindrical roll 70 having a diameter DA is provided just below the hearth roll 50 having a diameter DH and these two rolls 50, 70 are contacting with the same surface of the running steel strip 60 under tension. The auxiliary roll 70 is contacted with the strip 60 at the side advancing toward the hearth roll 50. The auxiliary roll 70 is horizontally displaced by LH from just below the hearth roll 50. In other words, the length LH is the distance between the vertical projections of the axes of the rolls 50 and 70. Further, the difference in the heights of the axes of the rolls 50 and 70 is denoted by LV in FIG. 9. When the auxiliary roll 70 is contacted by the steel strip 60 with a large contacting pressure, the wrinkles formed in the strip 60 are smoothened to contribute to the decrease in the eventuality of buckling which may otherwise occur in the steel strip 60. FIG. 14 is an elevational view of the same arrangement as in FIG. 9 as viewed in the direction perpendicular to the roll axis showing the advancing side of the steel strip 60. Further, FIG. 15 is a cross sectional view of the steel strip 60 in this case as cut and viewed in the direction of the arrows XV—XV in FIG. 14. As is shown in these figures, the wrinkles 66 on the steel strip 60 are dissolved at the auxiliary roll 70 so that the steel strip 60 winds around the hearth roll 50 as flattened and the eventuality of buckling thereof is greatly reduced.

Figure 8:
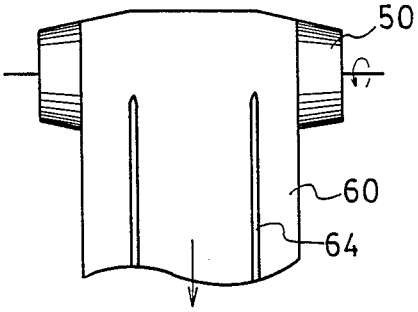
FIG. 8 is an elevational view of a hearth roll and a steel strip hanging on and leaving the roll with wrinkles.

The above description concerns the wrinkles or buckling in the steel strip 60 occurring at the side advancing toward the hearth roll 50. The wrinkles and buckling can be produced in the steel strip 60 similarly on the side leaving the hearth roll 50. FIG. 8 is an elevational view of the same arrangement of the hearth roll 50 and the steel strip 60 hanging thereon as in FIG. 6 but as viewed at the reverse side showing the steel strip 60 leaving the hearth roll 50. Wrinkles 64 are shown on the steel strip 60.

The steel strip 60 leaving the hearth roll 50 with the wrinkles 64 thereon as shown in FIG. 8 then arrives at the next hearth roll where the strip undergoes an unbending deformation so that buckling 61 with creases is produced as is shown in FIG. 5. Accordingly, it is also important to correct the wrinkled form of the steel strip 60 at the side leaving the hearth roll 50 in order to completely prevent buckling.

Figure 10:
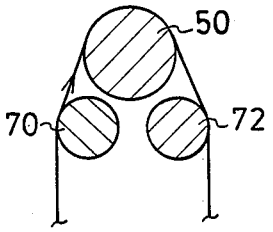
FIG. 10 is a cross sectional view of a hearth roll, two auxiliary cylindrical rolls and a steel strip hanging on the hearth roll as viewed in the axial direction of the rolls, the auxiliary rolls being at the advancing and leaving sides of the strip and contacting the same surface of the strip as the hearth roll.
Figure 11:
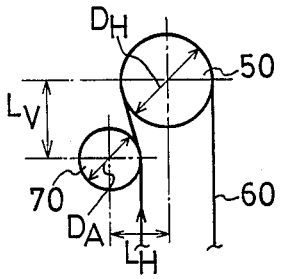
FIG. 11 is a cross sectional view of hearth roll, an auxiliary cylindrical roll and a steel strip hanging on the hearth roll as viewed in the axial direction of the rolls, the auxiliary roll being at the advancing side of the strip and contactiong the reverse surface to the hearth roll.
Figure 12:
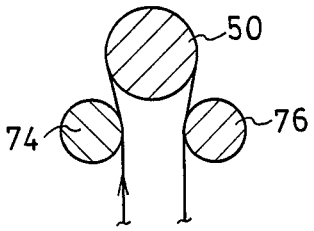
FIG. 12 is a cross sectional view of a hearth roll, two auxiliary cylindrical rolls and a steel strip hanging on the hearth roll as viewed in the axial direction of the rolls, the auxiliary rolls being at the advancing and leaving sides of the strip and contacting the reverse surface of the strip to the hearth roll.
Figure 13:
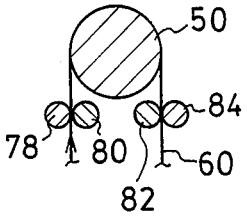
FIG. 13 is a cross sectional view of a hearth roll, two pairs of auxiliary cylindrical rolls and a steel strip as viewed in the axial direction of the rolls, the pairs of auxiliary rolls being at the advancing and leaving sides of the strip and the two rolls in each pair contacting the different surfaces of the strip.

When comparison is made for the phenomenon of buckling on the steel strip 60 between the advancing side and the leaving side relative to the hearth roll, the tension at which the buckling first takes place is lower at the advancing side than at the leaving side. Accordingly, it is primarily important, as is shown in FIGS. 9 and 11, to correct and smoothen the wrinkles on the steel strip 60 at the side advancing toward the hearth roll 50. When the thickness of the steel strip 60 is small and the material of the steel has a relatively small yield stress or, in other words, when the steel strip has good compliability to the surface of the hearth roll 50 and low rigidity resistible to buckling, however, it is also important to provide one or more of auxiliary cylindrical rolls in contact with the steel strip 60 at the side leaving the hearth roll 50 as is illustrated in FIGS. 10, 12 and 13.

Figure 16:
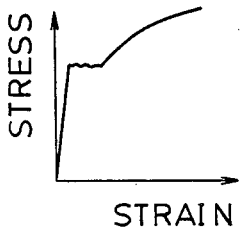
FIGS. 16 and 17 are each a schematic stress-strain diagram of steel at room temperature and at annealing temperature, respectively.
Figure 17:
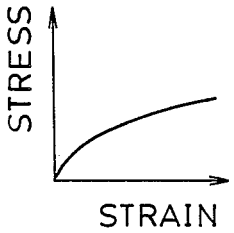

In respect of the diameter DA of the auxiliary cylindrical roll, decrease in the value of DA results in the increase in the stress produced in the longitudinal direction on the surface of the steel strip 60 in contact with the roll. When the stress-strain relationship in the steel strip 60 is as shown in FIG. 16, a crease perpendicular to the longitudinal direction is formed in the steel strip 60 by the increase of the length-wise stress over a certain value. It is noted, however, that the stress-strain relationship of a steel strip in the heating or soaking zone of the annealing furnace, where buckling of the strip most frequently takes place, is as shown by the smooth curve in FIG. 17 since the steel strip 60 in these zones is usually at a temperature of 700 to 850 degree Centigrade and less susceptible to the formation of creases. For the sake of increased safety, however, it is desirable to have an auxiliary cylindrical roll with a diameter DA large enough so that the ratio of the thickness of the steel strip to the value of DA should exceed the surface strain of the steel strip 60. For example, the smallest diameter DA of the auxiliary cylindrical roll would be 150 mm assuming a critical surface strain of the steel strip 60 equal to 0.002 and a thickness of the steel strip 60 equal to 0.3 mm.

In respect of the position of installation of the auxiliary cylindrical roll relative to the hearth roll, it is a preferable condition that a distance smaller than twice of the width of the steel strip is held between the contacting point of the auxiliary roll with the running steel strip 60 and the beginning or ending point of the winding contact between the hearth roll and the running steel strip. This means that the compressive stress in the transverse direction of the steel strip is significant due to the non-uniformity of the tension in such a range.

In an annealing furnace provided with the auxiliary cylindrical rolls 70–84 in the vicinity of the hearth rolls 50, a problem must be taken into consideration that the performance of the hearth rolls for the correction of meandering of the strip may sometimes be reduced because shift of the running steel strip 60 in the transverse direction is suppressed by the friction between the strip 60 and the auxiliary cylindrical rolls 70–84. This is in contrast to the conventional annealing furnaces having absolutely no factors between hearth rolls to suppress the transverse shift of the running steel strip in which meandering of the steel strip 60 can rapidly be corrected by virtue of the end-tapered or crowned configuration of the hearth roll to serve as a means for the correction of meandering.

The problem in this regard can be solved or mitigated by reducing the angle of contact between the steel strip 60 and the auxiliary cylindrical roll 70–84 as far as possible so as to minimize the contacting surface area therebetween as well as the pressure in the direction normal to the contacting surface. This means is effective to facilitate the transverse shift of the steel strip and to ensure the effect for the correction of the wrinkles produced in the steel strip 60 without affecting the effectiveness in the correction of meandering. Quite satisfactory results can be obtained in this connection when the angle of contact is 20 degrees or smaller between the steel strip 60 and the auxiliary cylindrical rolls 70–84 as spun at the center axis of the roll.

In order to establish the relationship between the position of installation of the auxiliary cylindrical roll 70 relative to the hearth roll 50 and the critical tension $T_{cr}$ of the steel strip 60, several experimental runs of annealing were undertaken in which the tension of the strip was gradually increased starting at 0.2 kg/mm$^2$ with the auxiliary cylindrical roll 70 installed at varied positions relative to the hearth roll 50. The critical tension $T_{cr}$ here implies the minimum tension applied to the steel strip over which the phenomenon of buckling takes place on either advancing or leaving side of the steel strip relative to the hearth roll.

Figure 20:
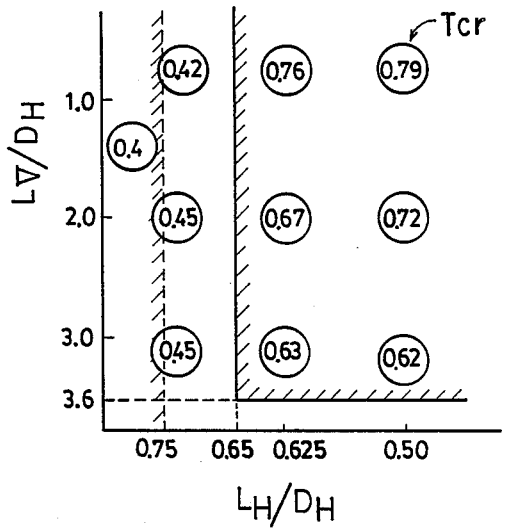
FIGS. 20 and 21 are each a diagram showing the acceptable disposition of the auxiliary cylindrical roll for the relative arrangement of the hearth roll, auxiliary cylindrical roll and steel strip illustrated in FIGS. 11 and 9, respectively.
Figure 21:
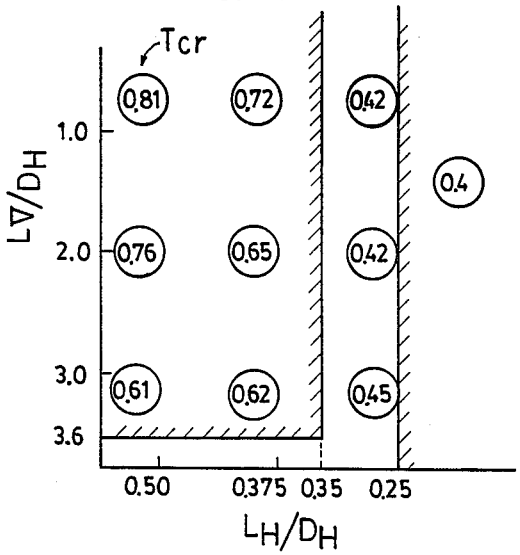

The steel strip employed in this experiment had the thickness of 0.7 mm and the width of 1280 mm, composed of extra-low carbon steel. The relative arrangement of the hearth roll 50, the auxiliary roll 70 and the steel strip 60 was as shown in FIG. 11. The diameters of the hearth roll 50 and the auxiliary roll 70 were 600 mm and 300 mm, respectively. The results of the experiment are shown in the diagram of FIG. 20 taking the dimensionless values of LH/DH as the abscissa and LV/DH as the ordinate. The definitions of LH, LV and DH are given before and also apparent from FIG. 11. In FIGS. 20 and 21, the value of the critical tension $T_{cr}$ each is located at each corresponding position on the coordinate.

When the value of LH/DH exceeds 0.75, the steel strip 60 and the auxiliary roll 70 are no longer in contact with each other so that the effect of the auxiliary roll 70 is completely lost in just the like manner as in conventional annealing furnaces in which no buckling-preventing effect can be expected. Such a condition corresponds to the left hatched area in FIG. 20 including the axis of ordinate. The critical tension $T_{cr}$ in this case is 0.4 kg/mm$^2$ over which buckling may take place. An extra-low carbon steel may be most eventual to occur buckling in practice, and the dimensions employed above are prevailing. Decrease in the tension level of the strip abovedescribed in order to prevent buckling obstructs the fitting between the strip and the hearth roll which causes insufficiency in meandering correction function effected by the convex hearth roll. The required tension value of the strip securing the meandering correction function is estimated no less than 0.5 kg/mm$^2$, more preferably the value being 0.6 kg/mm$^2$ or larger, i.e. not smaller than 1.5 times of the conventional critical tension value, in consideration of the varied conditions such as temperature variation in the furnace, dimensional difference of the strip, deviation of the material and so on. Such a condition corresponds to the right-side hatched area in the diagram of FIG. 20. When the relative arrangement of the rolls and the steel strip is as shown in FIG. 11, the auxiliary cylindrical roll 70 should be installed at a position relative to the hearth roll 50 to satisfy the following inequalities:

$$LV/DH \leqq 3.6; \quad (1)$$

and $$LH/DH \leqq 0.65. \quad (2a)$$

In this case, however, the amount of thrusting of the steel strip (0.5(DA+DH)−LH) is influenced by the diameter DA of the auxiliary roll 70 even when the value of LH is kept constant. Therefore, the above given inequality (2a) should be modified as follows taking the value of DA into consideration to ensure minimum thrusting of the steel strip:

$$LH/DH \leqq 0.41 + 0.5DA/DH. \quad (2)$$

Figure 9:
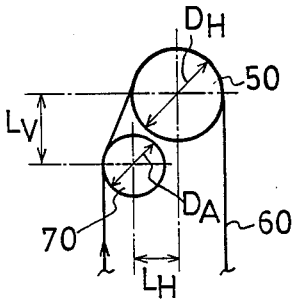
FIG. 9 is a cross sectional view of a hearth roll, an auxiliary cylindrical roll and a steel strip hanging on the hearth roll as viewed in the axial direction of the rolls, the auxiliary roll being at the advancing side of the strip and contacting the same surface of the strip as the hearth roll.

In the next place, explanation is given on the relationship between the critical tension $T_{cr}$ and the position of the auxiliary cylindrical roll relative to the hearth roll with reference to the results of the actual determination of $T_{cr}$ shown in FIG. 21 for the case where the relative arrangement of the rolls and the steel strip was as illustrated in FIG. 9. The same values are taken as the abscissa and ordinate as in FIG. 20. When the value of LH/DH is smaller than 0.25, the auxiliary roll 70 and the steel strip 60 are no longer contacted with each other so that the effect of buckling prevention naturally cannot be obtained by the installation of the auxiliary cylindrical roll 70. The hatched area at the right in FIG. 21 corresponds to such a condition. It is understood from this figure, on the other hand, that the critical tension $T_{cr}$ is increased by the increase in the value of LH/DH to push out the steel strip 60 away from the hearth roll 50 so that the eventuality of buckling is decreased. Assuming that the critical tension is 0.4 kg/mm$^2$ in the actual operation similarly to the explanation for FIG. 20, the hatched area at the left of FIG. 21 corresponds to the conditions under which the steel strip 60 is relatively free from both buckling and meandering in the actual operation of annealing. Following inequalities, in similar forms to the above given inequalities (1) and (2), are held in this area for the dimensionless values of LV/DH and LH/DH as the ordinate and abscissa in FIG. 21, respectively:

$$LV/DH \leqq 3.6; \quad (3)$$

and $$LH/DH \geqq 0.59 - 0.5DA/DH. \quad (4)$$

When meandering of the steel strip is desired to be prevented more efficiently, it is advantageous to decrease the surface roughness $R_a$ of the auxiliary cylindrical roll and to increase the surface roughness $R_a$ of the hearth roll. Suitable values of the surface roughness $R_a$ are, for example, about 1 micron for the auxiliary cylindrical roll and about 4 to 5 micron for the hearth roll.

In the arrangement of the rolls and strip illustrated in FIG. 13, two paris of auxiliary cylindrical rolls 78, 80 and 82, 84 are provided, the rolls in each pair facing different surfaces of the steel strip 60 at the same longitudinal position where the strip is just before reaching or just after leaving the hearth roll 50. The roll gap in each pair of the rolls 78, 80 or 82, 84 is adjusted to 1.0 to 1.2 times of the thickness of the steel strip so as to limit the deformation of the steel strip within this roll gap. Such an arrangement of the rolls and strip is very advantageous because the performance of the hearth roll for the correction of meandering is never affected by the installation of the auxiliary cylindrical rolls.

As an additional advantage in the arrangement illustrated in FIG. 13, the diameter of the auxiliary cylindrical rolls is under no limitation because the steel strip 60 in this case is free from the problem of occurrence of creases in the transverse direction. For example, the diameter of the roll can be smaller than 150 mm provided that the roll has a sufficient rigidity against bending.

It is desirable in the present invention that the peripheral velocity of the auxiliary cylindrical roll is controlled to coincide with the running velocity of the steel strip in order to avoid scratch formation on the surface of the strip by contacting with the auxiliary rolls. Suitable controlling means of the rotational velocity of the auxiliary rolls include, for example, the VVVF (variable voltage variable frequency) control.

In the following, the method of the present invention is described in more detail by way of an illustrative example.

EXAMPLE

In a continuous-process vertical annealing furnace as illustrated in FIG. 1, each of the three upper hearth rolls 50 nearest to the exit of the heating zone 30 and the three upper hearth rolls 50 nearest to the inlet of the soaking zone 40 was coupled with an auxiliary cylindrical roll or rolls. The relative arrangement of the hearth roll, auxiliary rolls and steel strip was as shown in FIGS. 9, 10, 11 or 13 in each of the test runs. For comparison, one of the test runs was performed without installation of the auxiliary cylindrical rolls.

Figure 18:
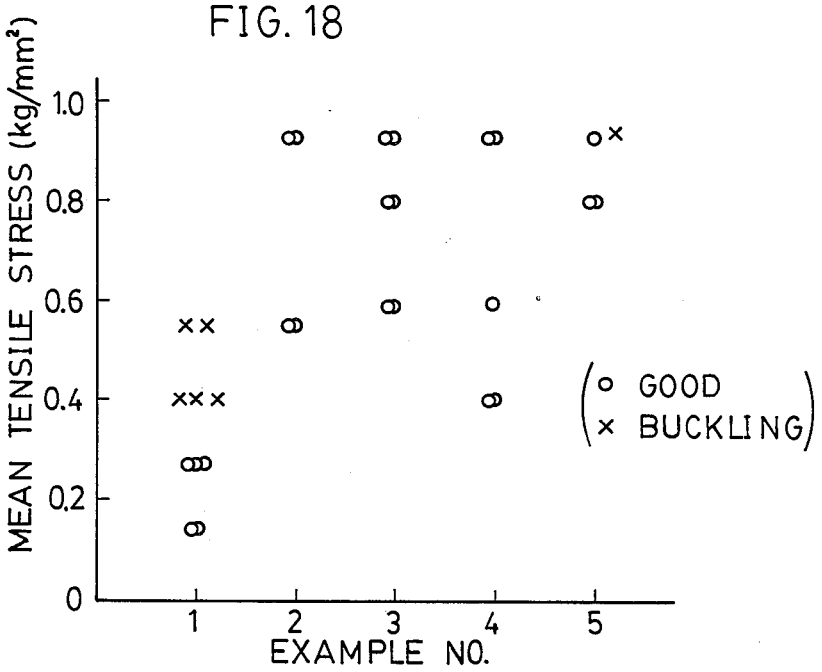
FIGS. 18 and 19 are each a graphic illustration of the critical tension for the occurrence of buckling in a steel strip at the advancing and leaving sides relative to the hearth roll, respectively.
Figure 19:
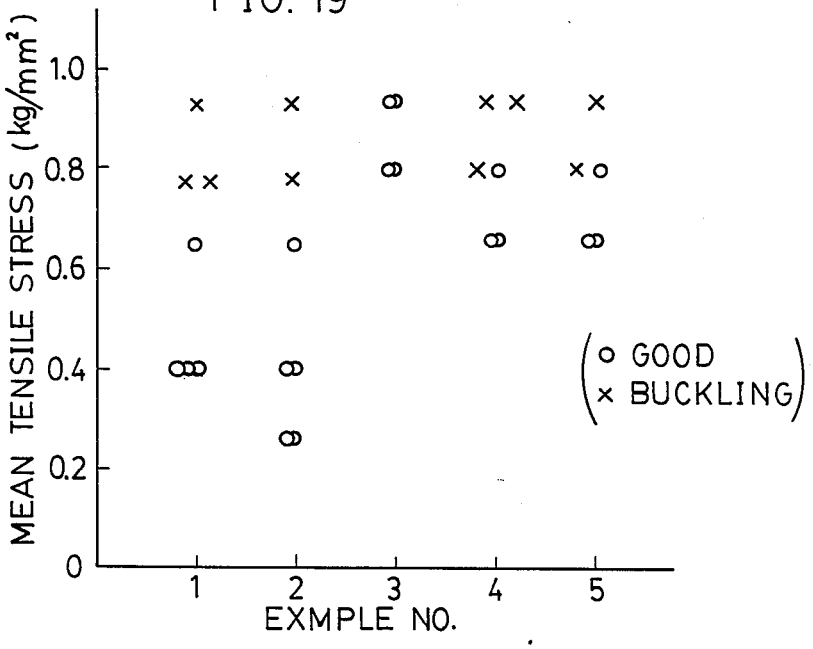

Each of the end-tapered hearth rolls had a straightly cylindrical center portion of 460 mm long where the diameter was 600 mm and the taper angle $\theta$ (see FIG. 2) at each tapered portion was given by tan $\theta$=0.0009. Each of the auxiliary rolls coupled with the hearth rolls was straightly cylindrical having a diameter of 300 mm. A strip of extra-low carbon steel containing 0.003% carbon having a thickness of 0.7 mm and width of 1280 mm was passed through the annealing furnace at a velocity of 200 m/minute and heat-treated. The meandering behavior of the steel strip in each of the runs was as shown in the table below by three ratings A, B and C corresponding to the meandering behavior (A) without improvement in comparison with the conventional method, (B) with almost no problem and (C) practically with no problem in operation though with some time lag in the correction of meandering, respectively. Further, appearance or absence of buckling in the steel strip is indicated in FIGS. 18 and 19 in relation to the average tension of the steel strip. FIG. 18 is for the advancing side of the steel strip toward the hearth roll and FIG. 19 is for the strip after leaving the hearth roll.

TABLE

| Run No. | Arrangement of rolls and strip | Meandering behavior |
|---|---|---|
| 1 | No auxiliary rolls | A |
| 2 | FIG. 9 | B |
| 3 | FIG. 10 | C |
| 4 | FIG. 11 | B |
| 5 | FIG. 13 | A |

In Run No. 1 undertaken for comparative purpose without installation of the auxiliary cylindrical rolls, the phenomenon of buckling took place in the steel strip at the advancing side toward the hearth roll when the average tension of the steel strip was 0.4 kg/mm$^2$ or larger. (shown with x)

On the other hand, the tension of the steel strip for the appearance of buckling was substantially larger than above in Runs No. 2 to No. 5 carried out with installation of the auxiliary cylindrical rolls according to the inventive method. For example, the average tension could be increased to 1.6 to 1.7 times of the upper limit value in the conventional method without appearance of buckling in Runs No. 2 and No. 4 in which the auxiliary cylindrical roll was installed at the advancing side of the steel strip toward the hearth roll. That can be easily understood by comparing the limit buckling stress of Run No. 1 in FIG. 18 with those of Runs No. 2 and No. 4 in FIG. 19. Furthermore, the average tension of the steel strip could be increased to twice or larger of the upper limit value in the conventional method without buckling at both sides of the steel strip relative to the hearth roll in Run No. 3 in which two auxiliary cylindrical rolls were provided at different sides of the steel strip relative to the hearth roll as is illustrated in FIG. 10. (See FIGS. 18 and 19) Although the efficiency of meandering correction was somewhat less satisfactory in Run No. 3 than in the conventional method, it was not practically unacceptable. Quite satisfactory results could be obtained in Run No. 5 in both respects of buckling prevention and meandering correction.

What is claimed is:

1. A method for continuously annealing a steel strip of a continuous length which comprises, in a process in which the steel strip is continuously passed through a vertical annealing furnace comprising a heating zone, and a soaking zone connected in series and the steel strip runs through these zones in this order, each of which zones is provided with two sets of hearth rolls each having an end-tapered or crowned configuration with the largest diameter DH in the upper and lower parts of the zone with the axes thereof being substantially in parallel with each other, the running steel strip being guided alternately by one of the upper hearth rolls and one of the lower hearth rolls, providing at least one straightly cylindrical auxiliary roll having a diameter DA at a position where the auxiliary roll can be contacted with the running steel strip, keeping the height difference LV between the axes of the hearth roll and the auxiliary roll not larger than 3.6 times of the DH, and keeping the tension of the running steel strip at least 1.5 times as large as a critical tension in excess of which buckling takes place in the steel strip in the absence of the auxiliary roll.

2. The method as claimed in claim 1, wherein the straightly cylindrical auxiliary roll is in contact with the same surface of the running steel strip as the hearth roll on the advancing side of the steel strip toward the hearth roll and at such a position that the inequality $$LH/DH \geqq 0.59 - 0.5DA/DH,$$

in which DA and DH each have the meaning as defined above and LH is the distance on a horizontal plane between the vertical projections of the axes of the hearth roll and the auxiliary roll, is satisfied.

3. The method as claimed in claim 1 wherein the auxiliary roll is in contact with the surface of the steel strip opposite to the surface in contact with the hearth roll on the advancing side of the steel strip toward the hearth roll and at such a position that the inequality $$LH/DH \leqq 0.41 + 0.5DA/DH,$$

in which DH and DA each have the meaning as defined above and LH is the distance on a horizontal plane between the vertical projections of the axes of the hearth roll and the auxiliary roll, is satisfied.

4. The method as claimed in claim 1, wherein two straightly cylindrical auxiliary rolls are provided per one hearth roll each in contact with the surface of the steel strip opposite to the surface in contact with the hearth roll on the advancing side and on the leaving side of the steel strip relative to the hearth roll and each at such a position that the inequality $$LH/DH \leqq 0.41 + 0.5DA/DH,$$

in which DH and DA each have the meaning as defined above and LH is the distance on a horizontal plane between the vertical projections of the axes of the hearth roll and the auxiliary roll, is satisfied.

* * * * *